US011261070B2

(12) United States Patent
Huckestein

(10) Patent No.: US 11,261,070 B2
(45) Date of Patent: Mar. 1, 2022

(54) CORK EXTRACTOR

(71) Applicant: William Huckestein, Oxnard, CA (US)

(72) Inventor: William Huckestein, Oxnard, CA (US)

( * ) Notice: Subject to any disclaimer, the term of this patent is extended or adjusted under 35 U.S.C. 154(b) by 254 days.

(21) Appl. No.: 16/702,396

(22) Filed: Dec. 3, 2019

(65) Prior Publication Data

US 2020/0283280 A1 Sep. 10, 2020

Related U.S. Application Data

(60) Provisional application No. 62/814,733, filed on Mar. 6, 2019.

(51) Int. Cl.
*B67B 7/04* (2006.01)

(52) U.S. Cl.
CPC ..... *B67B 7/0405* (2013.01)

(58) Field of Classification Search
CPC ..... B67B 7/04; B67B 7/0405; B67B 7/40
USPC ..... 81/3.2, 3.45
See application file for complete search history.

(56) References Cited

U.S. PATENT DOCUMENTS

| | | | |
|---|---|---|---|
| 2003/0029276 | A1 | 2/2003 | Falcone |
| 2010/0206136 | A1 | 8/2010 | Cheung |
| 2018/0050895 | A1 | 2/2018 | Liu |

FOREIGN PATENT DOCUMENTS

| | | | |
|---|---|---|---|
| JP | 07-206089 | A | 8/1995 |
| KR | 10-0776355 | B1 | 11/2007 |

*Primary Examiner* — David B. Thomas
*Assistant Examiner* — Thomas Raymond Rodgers
(74) *Attorney, Agent, or Firm* — Paul D. Chancellor; Ocean Law

(57) ABSTRACT

An automated cork extractor includes a housing for enclosing a motor, a corkscrew, and a cork sleeve that does not move with respect to the housing during extraction of a cork from a bottle neck.

5 Claims, 17 Drawing Sheets

FIG. 6B

600B

| | S0 Safety+ | S1 Remove Cork (Forward) | S2 Drop Cork (Reverse) | S3 Drop Cork (Reverse) | S4 Safety- | S5 Cork Sensor |
|---|---|---|---|---|---|---|
| **Not In Use** | Closed | Open | Open | Open | Closed | Closed |
| **Remove Cork** | Closed | Closed | Open | Open | Closed | Closed |
| **Stop** | Closed | Closed | Open | Open | Closed | Open |
| **Eject Cork** | Open | Open | Closed | Closed | Open | No Effect |

600D

| | S1 Remove Cork (Forward) | S2 Drop Cork (Reverse) | S3 Drop Cork (Reverse) | S4 Safety | S5 Cork Sensor |
|---|---|---|---|---|---|
| **Remove Cork** | Closed | Open | Open | Closed | Closed |
| **Stop** | Closed | Open | Open | Closed | Open |
| **Eject Cork** | Open | Closed | Closed | Open | No Effect |

CORK EXTRACTOR

PRIORITY CLAIM AND INCORPORATION BY REFERENCE

This application claims the benefit of Prov. Pat. App. No. 62/814,733 with the title CORK EXTRACTOR. This application incorporates by reference Prov. App. No. 62/814,733 filed Mar. 6, 2019 for all intents and purposes.

BACKGROUND OF THE INVENTION

Field of the Invention

The present invention relates to an article of manufacture and a method of using that article for removing corks. In particular, an automated cork extractor includes a corkscrew and engages a bottle for removing a cork seated in a bottle neck.

Discussion of the Related Art

Manual and automated cork extractors for removing corks from wine bottles are known. Manual devices include a handle affixed to a corkscrew and are operated when a bottle is held in one hand and a corkscrew is held in the other hand. Contrasted with the manual device are automated devices utilizing a motor driven corkscrew to engages the cork. As the user holds the extractor in one hand and the bottle in the other, the bottle is at first pulled into the extractor after which the cork is pulled from the bottle. With both manual and automated cork extractors, the process requires that two hands be used on the device. For example, one hand must hold the cork extractor in a proper position relative to a bottle and one hand must hold the wine bottle to prevent the bottle from spinning with the corkscrew.

SUMMARY OF THE INVENTION

The present invention provides a cork extractor. Embodiments of the cork extractor may be automated and require only one hand for operation and/or require a reduced effort to hold the bottle and/or extractor.

In various embodiments, the cork extractor may comprise any of: an extractor housing; fixed with respect to each other and fixed to the extractor housing, a motor and a cork sleeve; a housing pocket and articulated therefrom a lever for rotatably grasping the neck of a bottle and for holding the bottle irrotatable with respect to the extractor; a telescoping section coupled between a motor shaft and a corkscrew; and, a spring urging elongation of the telescoping section; wherein, insertion of the bottle neck into the pocket compresses the spring and closing the lever against the bottle neck irrotatably fixes the bottle to the extractor and runs the motor in a forward direction to advance the corkscrew into the cork, the telescoping section elongating until interference with a cork sleeve cap stops elongation and begins withdrawal of the cork from the bottle neck.

In an embodiment a cork extractor comprises: a shaft interconnecting a corkscrew and a motor; the corkscrew interconnected with the shaft via a cylindrical ramp encircling the shaft; a post extending radially from the shaft, the post for engaging a cylindrical ramp coil; the corkscrew for entering a cork lodged in a bottle and fixed with respect to the motor; and, the cork removed from the bottle when the corkscrew rotates but does not translate with respect to the cork.

In an embodiment a cork extractor includes: an internally ribbed cork sleeve fixed with respect to the motor; the cork sleeve for abutting a bottle mouth, the corkscrew passing through the cork sleeve; the cork drawn into the cork sleeve when the cork is removed from the bottle; and, the cork ejected from the cork sleeve when the motor reverses its direction of rotation, the cylindrical ramp translates toward the motor, and the corkscrew exits the cork.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

FIGS. 6A-D show interconnection of switching devices for use with the extractor of FIGS. 1A-B.

DESCRIPTION OF THE PREFERRED EMBODIMENTS

The disclosure provided herein describes examples of some embodiments of the invention. The designs, figures, and descriptions are non-limiting examples of the embodiments they disclose. For example, other embodiments of the disclosed device and/or method may or may not include the features described herein. Moreover, disclosed advantages and benefits may apply to only certain embodiments of the invention and should not be used to limit the disclosed invention.

Figure 1A:
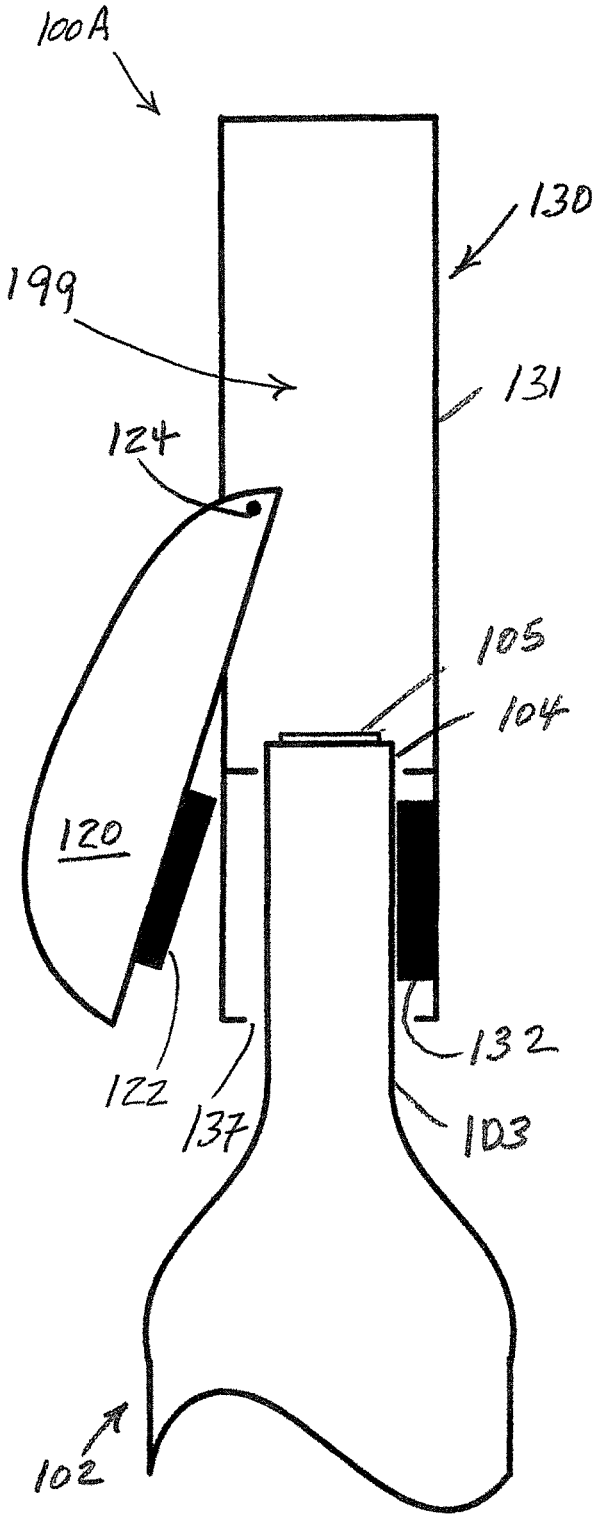
FIGS. 1A-B show a bottle cork extractor in accordance with the present invention.
Figure 1B:
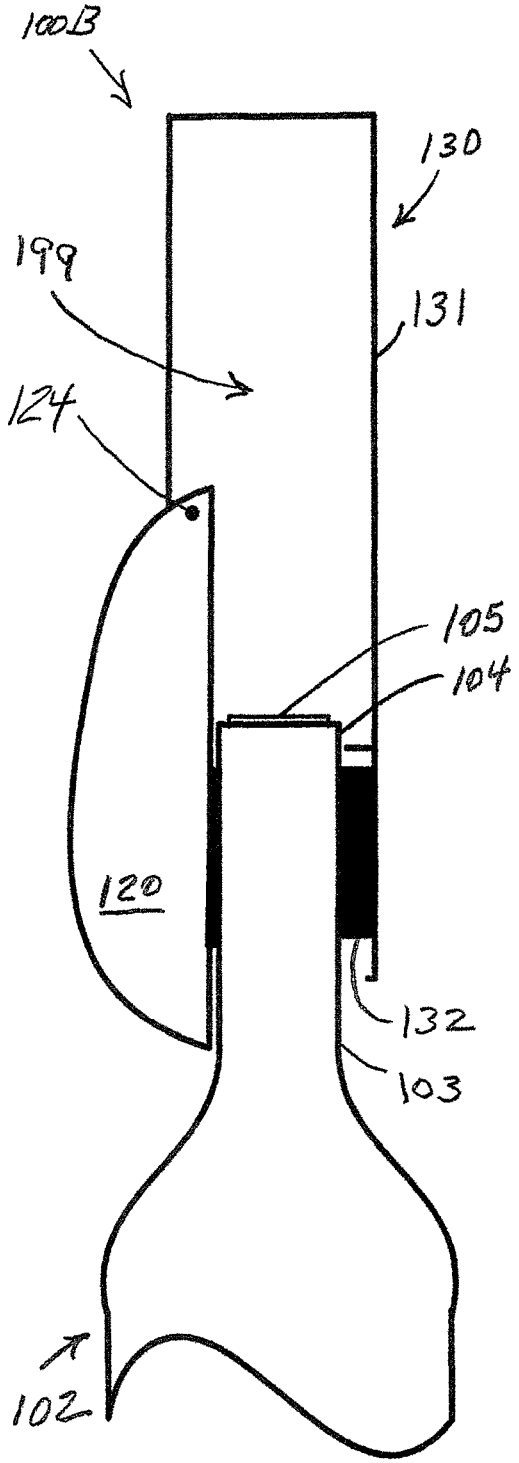

FIGS. 1A-B show a bottle 102 and a cork extractor 130 referred to herein as an extractor 100A-B. For clarity, this view omits the cork extractor motor assembly 199 seen in FIG. 1C.

As seen, a cork 105 is inserted in the bottle neck 103 at a mouth 104 of the bottle. The extractor 130 provides a passage or space 137 for receiving the bottle neck 103. A lever 120 that is pivotally attached 124 to the extractor housing 131 provides a means for receiving and grasping the bottle neck.

In FIG. 1A, the lever is open 100A for receiving the bottle neck 103. In FIG. 1B, the lever is closed 100B for holding the bottle irrotatably with respect to the extractor 130. In various embodiments, a compliant material such as foam 122, 132 provides opposed jaws that grasp the bottle neck when the lever is closed. Notably, other embodiments may provide dual or dual opposed levers to hold the bottle irrotatably with respect to the extractor.

Operation of the lever 120 to fix the bottle in the extractor 130 may occur when a user wraps a hand around the extractor and in so doing closes the lever against the bottle neck 103. It is noted that with the lever closed, the bottle 102 and the extractor can be manipulated with one hand as they are fixed together as one unit.

The cork extractor motor assembly may include a motor and a corkscrew with a telescoping element/section therebetween. The cork extractor may include a cork sleeve that is stationary with respect to the extractor housing.

Figure 1C:
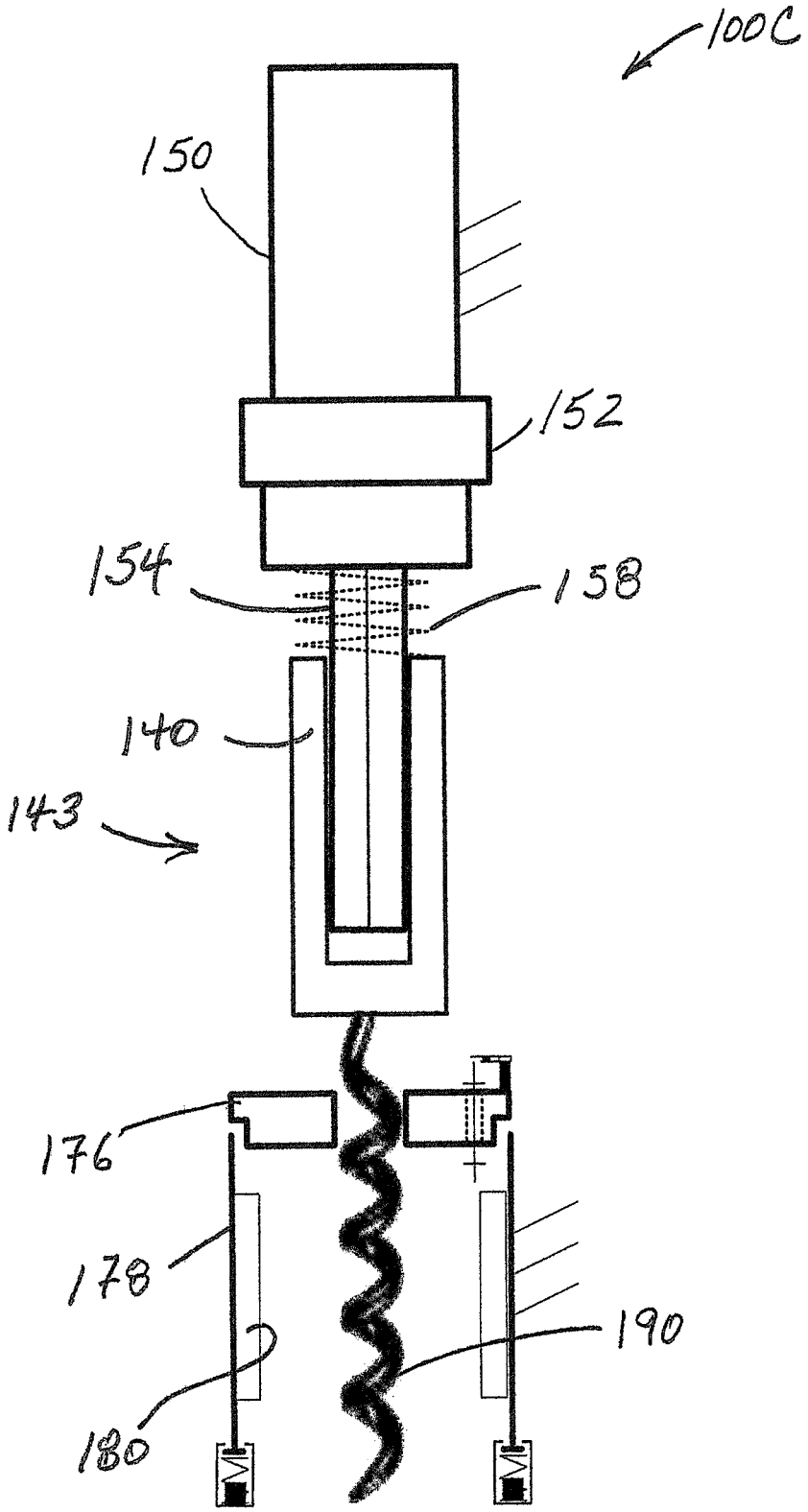
FIG. 1C shows a first cork extraction mechanism for use with the extractor of FIGS. 1A-B.

FIG. 1C shows an embodiment 100C of a cork extractor motor assembly 199. Here, a motor 150 is operable to turn a corkscrew 190 via a telescoping section 143 that includes a sliding collar 140 turned by a motor shaft 154. The motor may include a gearbox 152. The motor shaft has a cross-section that allows it to slide up and down within the collar but constrains it to rotate with the collar. For example, the motor may have a shaft with a square cross-section and the collar may have a mating cross-section.

The movable collar 140 is urged by a coil spring 158 around the shaft 154 to extend toward the cork sleeve 178 and its cap 176. This telescoping/extending action of the collar is limited when the collar strikes the cap 176.

Since the cork sleeve is fixed to the extractor housing 131, the force between the collar 140 and the cap 176 balances the force used to extract the cork 105 from the bottle 102.

In operation, the cork is extracted when the corkscrew 190 meets the cork 105 and the motor turns the corkscrew into the cork. That is, when the corkscrew enters the cork, the cork advances along the length of the corkscrew as it rises in the cork sleeve 178 and is removed from the bottle. Notably, ribs 180 in the cork sleeve prevent the cork from turning inside the cork sleeve. A more fulsome description of this process is found below.

Figure 1D:
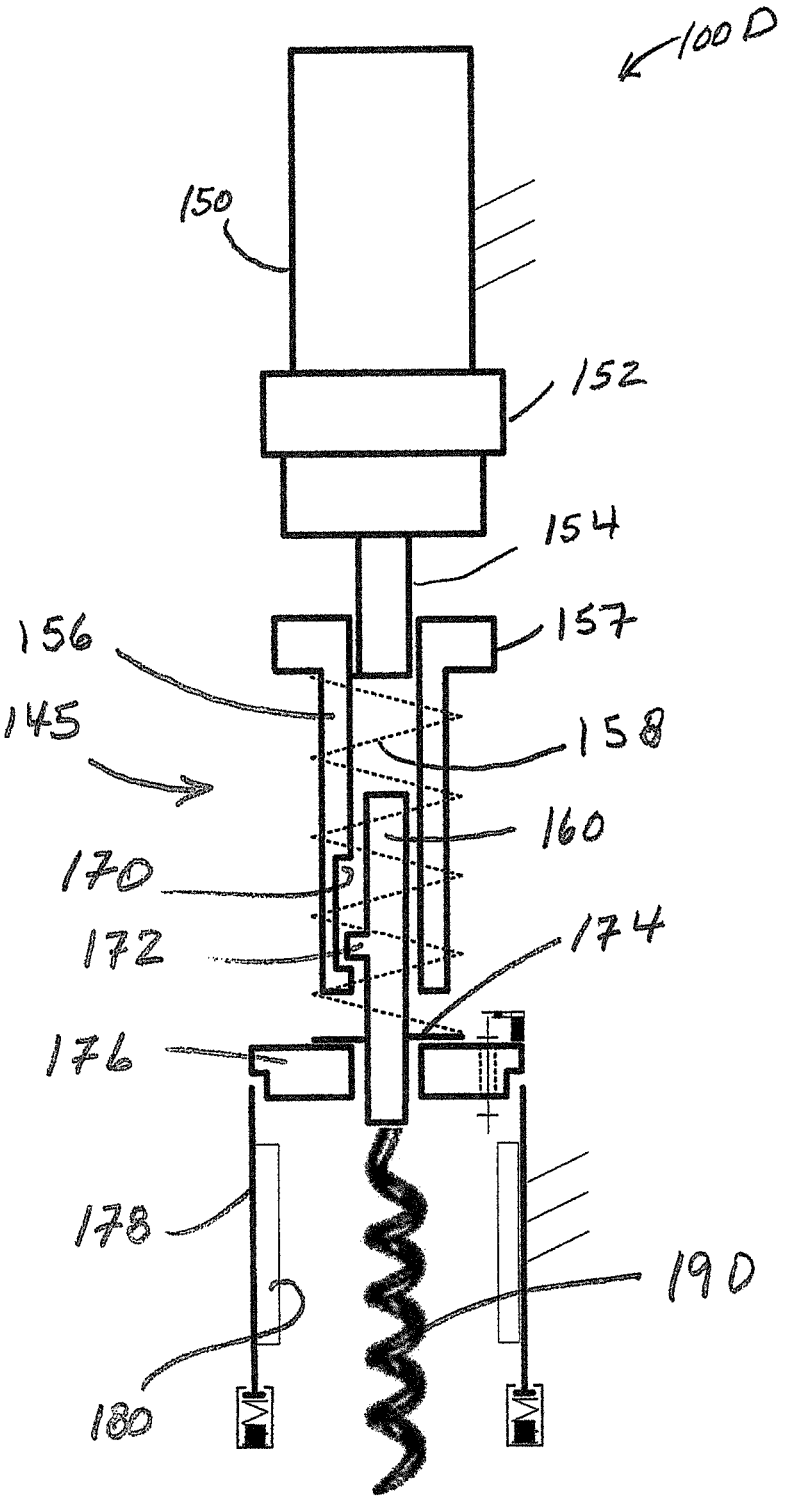
FIG. 1D shows a second cork extraction mechanism for use with the extractor of FIGS. 1A-B.

FIG. 1D shows another embodiment 100D of a cork extractor motor assembly 199. Here, a motor 150 is operable to turn a corkscrew 190 via a telescoping section 145 that includes a collar 156 turned by a motor shaft 154 and a pin 160 that is extentable from the collar. The pin includes a side tang 172 that fits in a collar groove 170 such that the pin is forced to rotate with the collar.

The pin 160 is urged by a coil spring 158 around the collar 156 to extend from the collar and the extent of the telescoping/extendable action of the pin 160 in the collar 156 is limited by the collar groove 170 length or by stop plate 174 on the pin. The spring may be located between a collar shoulder 157 and the pin plate 174.

For example, the pin stop plate may be fixed to the pin such that when the pin is lowered, the stop plate strikes a cap 176 at the upper end of cork sleeve 178. Since the cork sleeve is fixed to the extractor housing 131, the force between the stop plate and the cap balances the force used to extract the cork 105 from the bottle 102.

In operation, the cork is extracted when the corkscrew 190 meets the cork 105 and the motor turns the corkscrew into the cork. That is, when the corkscrew enters the cork, the cork advances along the length of the corkscrew as it rises in the cork sleeve 178 and is removed from the bottle. Notably, ribs 180 in the cork sleeve prevent the cork from turning inside the cork sleeve. A more fulsome description of this process is found below. In a particular embodiment, the spring urges the corkscrew to penetrate the cork, for example about one spiral length (about 1 cm), and then the corkscrew telescoping action provides for an additional penetration of the corkscrew in the cork, for example about one spiral length (about 1 com), prior to operations that extract the cork from the bottle.

Figure 2A:
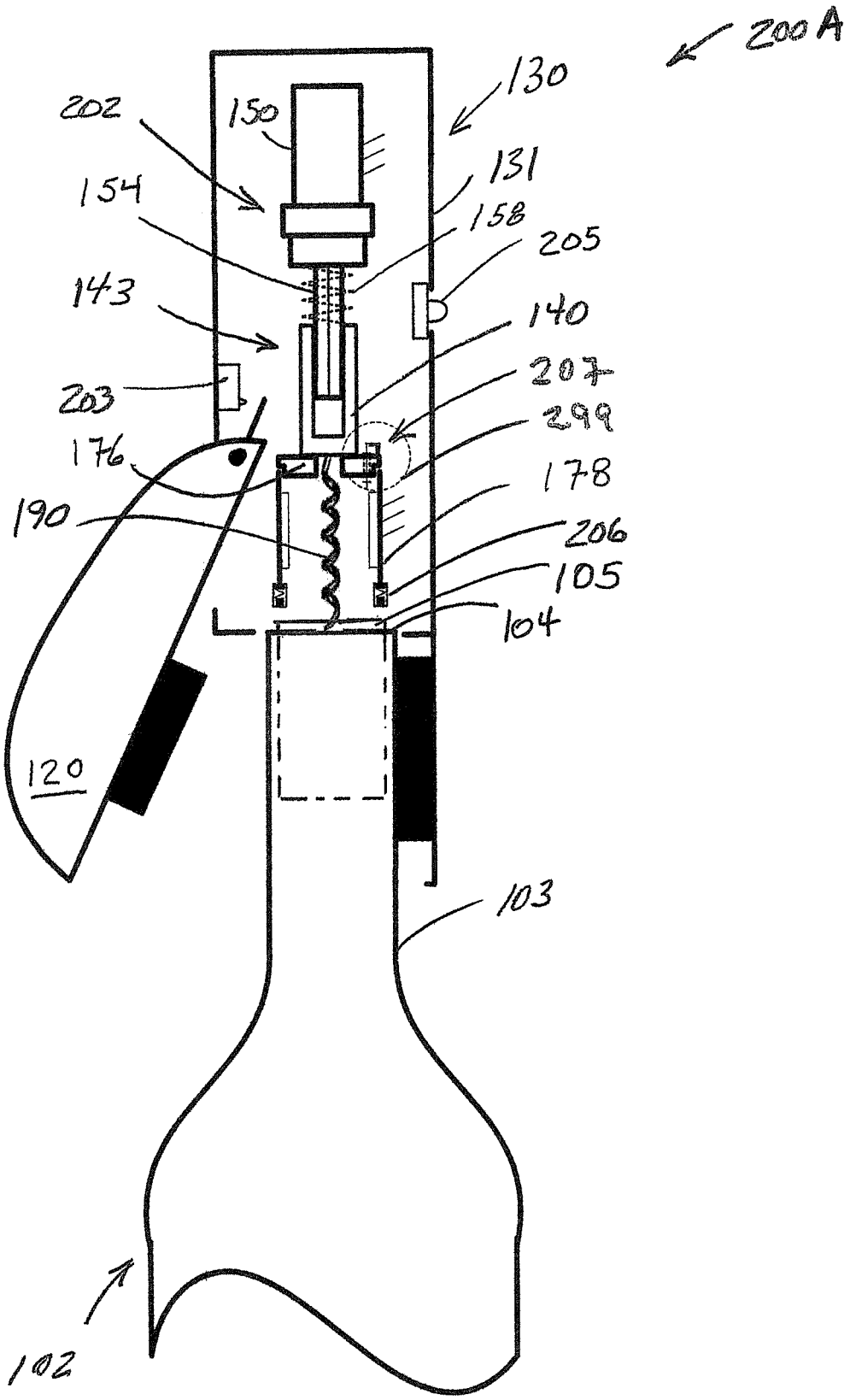
FIGS. 2A-C show extractors utilizing different cork extraction mechanisms for use with the extractor of FIGS. 1A-B.

FIG. 2A shows 200A a bottle 102 inserted in an extractor 130. The extractor includes a cork extractor mechanism 202 which includes a sliding collar telescoping section 143. As described above, the telescoping section operates when collar 140 slides along the motor shaft 154. The collar slides away from the cork sleeve when the corkscrew 190 and cork 105 meet and push the collar toward the motor 150. The collar slides toward the cork sleeve when the corkscrew turns into the cork 105 and pulls the collar away from the motor.

Electrical switches may be used to control operation of the extractor. Switches may include any of a lever switch 203 operated by a user lever 120, a bottle mouth switch 206 operated by the bottle mouth 104, an extractor housing switch 205 operated by a user, and a cork sensor switch 207 located at the cork sleeve cap 299. Notably, the lever and extractor housing switches are operable using a single hand, for example a thumb may operate the extractor housing switch and other finger(s) may operate the lever. In an embodiment, the extractor corkscrew motor runs when two switch conditions are satisfied. A first condition occurs when "push-down" of the device on a bottle compresses the spring and actuates the bottle mouth switch 206. And the second condition occurs when squeezing the lever actuates lever switch 203. For example, a single hand may squeeze the lever to hold the wine bottle in place, the same squeezing action concurrently causing the extractor to begin and/or complete the cork extraction process.

Figure 2B:
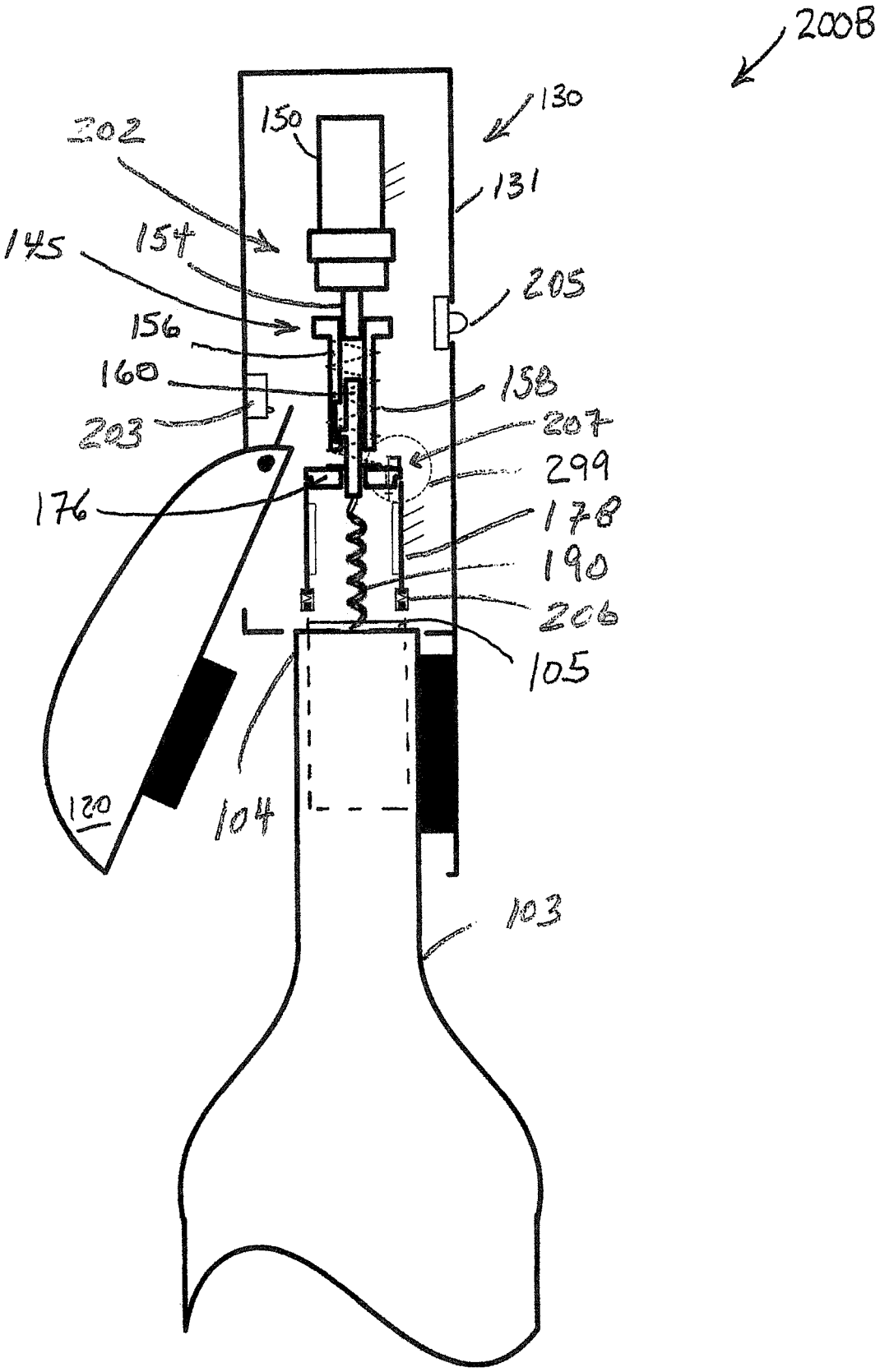

FIG. 2B shows 200B a bottle 102 inserted in an extractor 130. The extractor includes a cork extractor mechanism 202 which includes a telescoping section 145. As described above, the telescoping section operates when pin 160 slides inside collar 156. The pin slides away from the cork sleeve 178 when the corkscrew 190 and cork 105 meet and push the pin toward the motor 150. The pin slides toward the cork sleeve when the corkscrew turns into the cork 105 and the pin moves away from the motor.

Electrical switches may be used to control operation of the extractor. Switches may include any of a lever switch 203 operated by a user lever 120, a bottle mouth switch 206 operated by the bottle mouth 104, an extractor housing switch 205 operated by a user, and a cork sensor switch 207. For example, the lever and extractor housing switches are operable using a single hand, for example a thumb may operate the extractor housing switch and other finger(s) may operate the lever. For example, the lever and lever switch 203 may be operable using a single hand requiring only a squeeze action of the lever to actuate the switch 203.

Figure 2C:
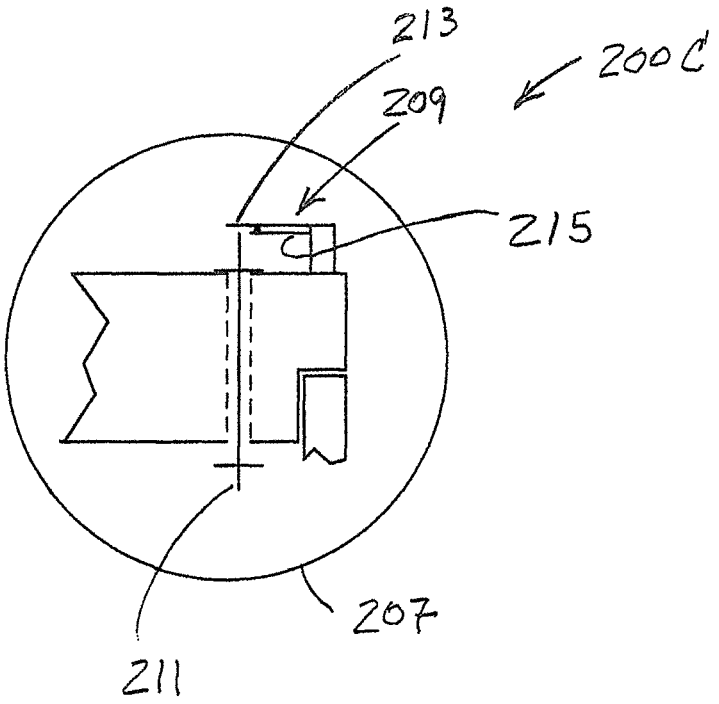

FIG. 2C shows an enlarged view 200C of the cork sensor switch location 207 and of the cork sensor switch 209. In particular, the cork sensor switch includes a plunger 211 that is pushed by a cork that, during extraction rises in cork sleeve 178. The rising plunger strikes a switch leaf 213 and pushes it away from switch leaf 215 which opens the cork sensor switch.

Figure 3:
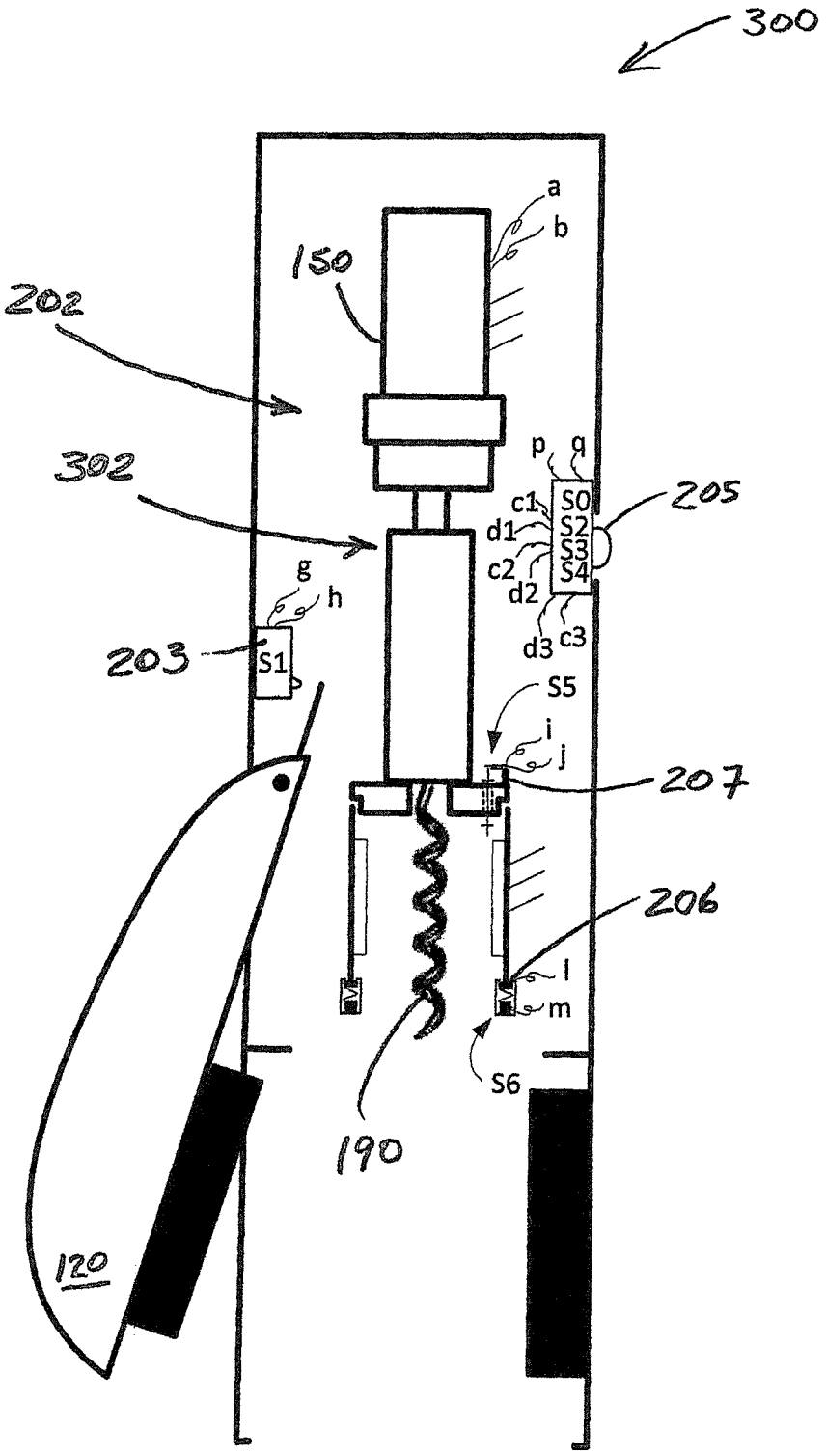
FIG. 3 shows a cork extractor with switching devices for use with the extractor of FIGS. 1A-B.
Figure 6A:
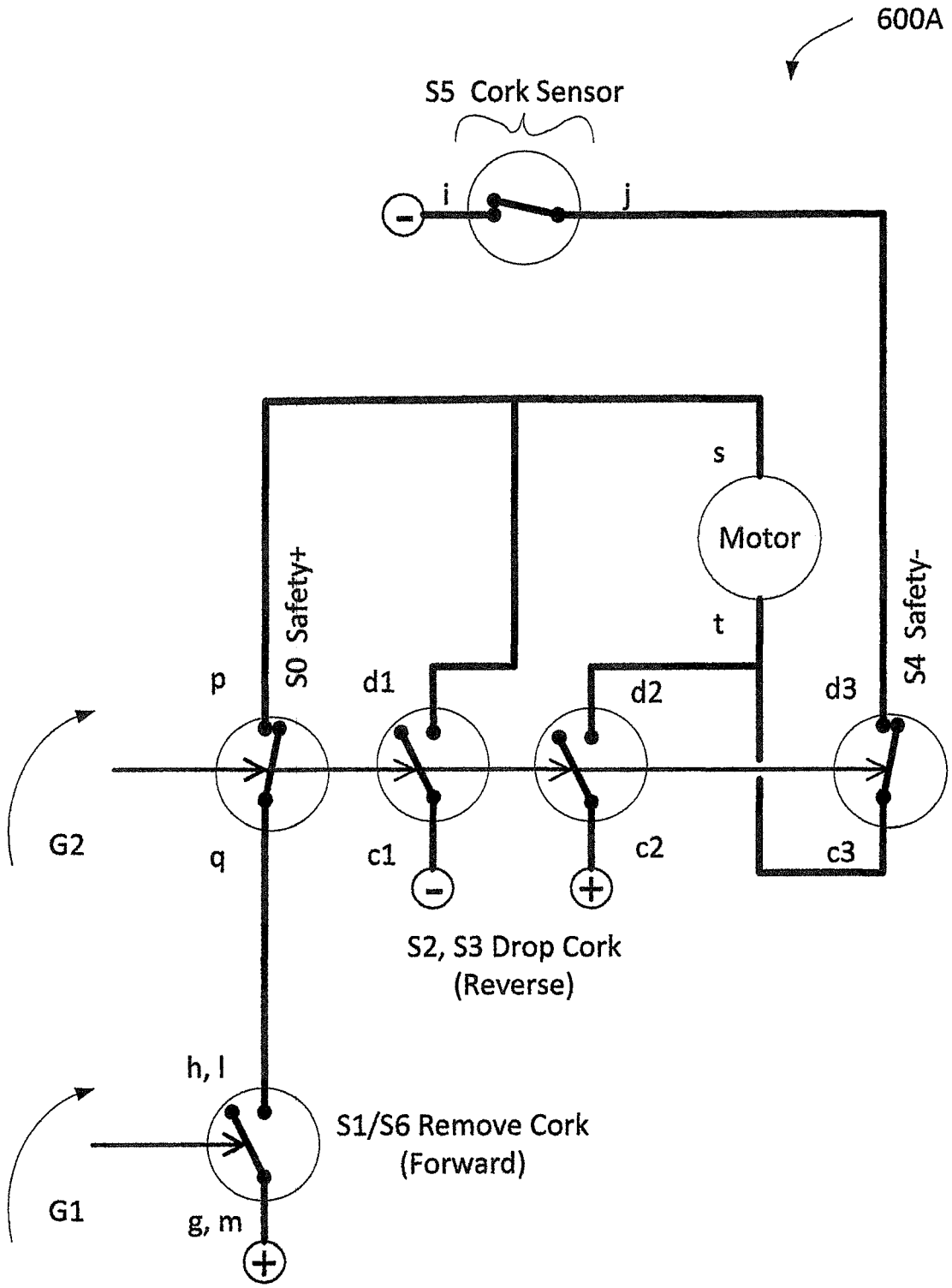

FIG. 3 shows electrical connections to the motor and to the switches 300. Motor electrical connections are a and b. Lever switch S1 203 includes a normally open switch with two electrical connections, g and h. Extractor housing switch S2/S3/S4 205 includes two normally open switches S2, S3 and one normally closed switch S4. S2 electrical connections are c1 and d1; S3 electrical connections are c2 and d2; and, S4 electrical connections are c3 and d3. Cork sensor switch S5 207 includes a normally closed switch with two electrical connections i and j. Bottle mouth switch S6 206 includes a normally open switch with two electrical connections l and m. In various embodiments another switch S0 with connections p and q is used and this switch may be incorporated with the extractor housing switch group mentioned above (see FIG. 6A). Item 302 indicates the location of a telescoping section such as those described above. FIG. 6A,B indicate how some or all of these switches are electrically interconnected.

In a first embodiment, FIGS. 4A-F show details of mechanical operation 400A-F for the cork extractor mechanism 202 which includes a telescoping section 143 where a collar 140 slides on a motor shaft 154. Note that the motor 150 and the cork sleeve 178 are fixed with respect to each other. For example, each of the motor and cork sleeve may be fixed to the extractor housing 131 as illustrated above.

Figure 4A:
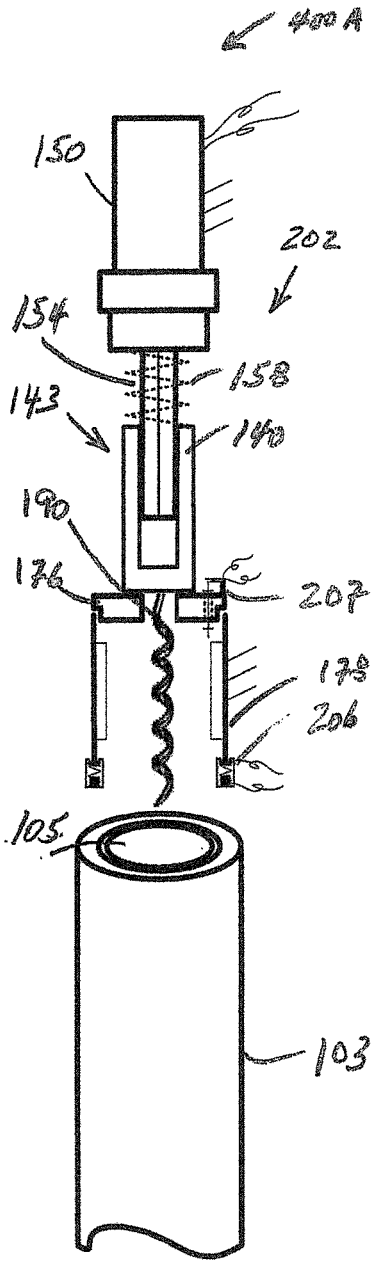
FIGS. 4A-F show use of a first cork extractor similar to the one of FIG. 1C.

In FIG. 4A the cork 105 has yet to reach and meet the corkscrew 190. Forward motor operation may be controlled by the bottle rim switch 206 or by the lever switch 203 or by both of these switches. In an embodiment, the motor is not operating at this time.

Figure 4B:
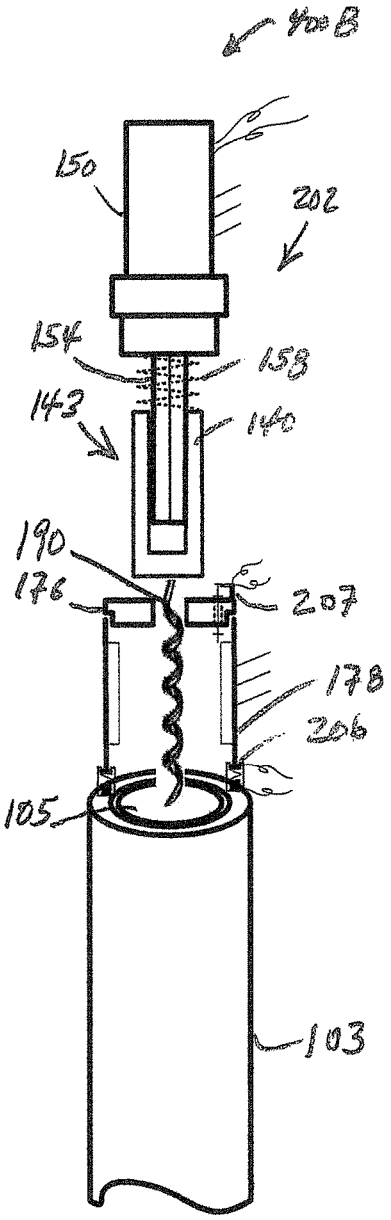

In FIG. 4B, the cork 105 has reached and meets the corkscrew 190. As seen, the spring 158 is compressed as the sliding collar 140 is lifted up by cork/corkscrew contact. Forward motor operation will advance the corkscrew 190, which is biased toward the cork by the spring, into the cork. As mentioned above, forward motor operation may be controlled by the bottle rim switch 206 or by the lever switch 203 or by both of these switches. In an embodiment, the forward motor operation begins at this time.

Figure 4C:
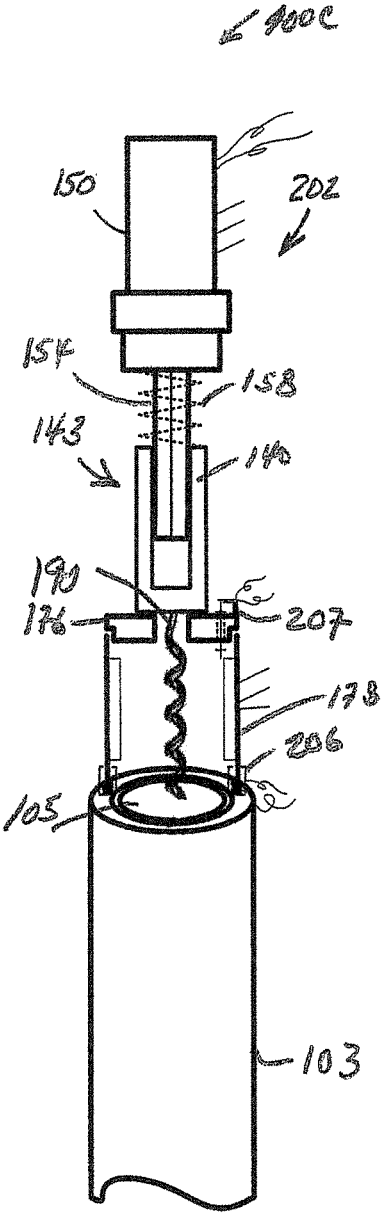

In FIG. 4C, during forward motor operation the corkscrew 190 has turned a distance into the cork 105 as the sliding collar 140 is returned to a position atop the cork sleeve cap 176.

Figure 4D:
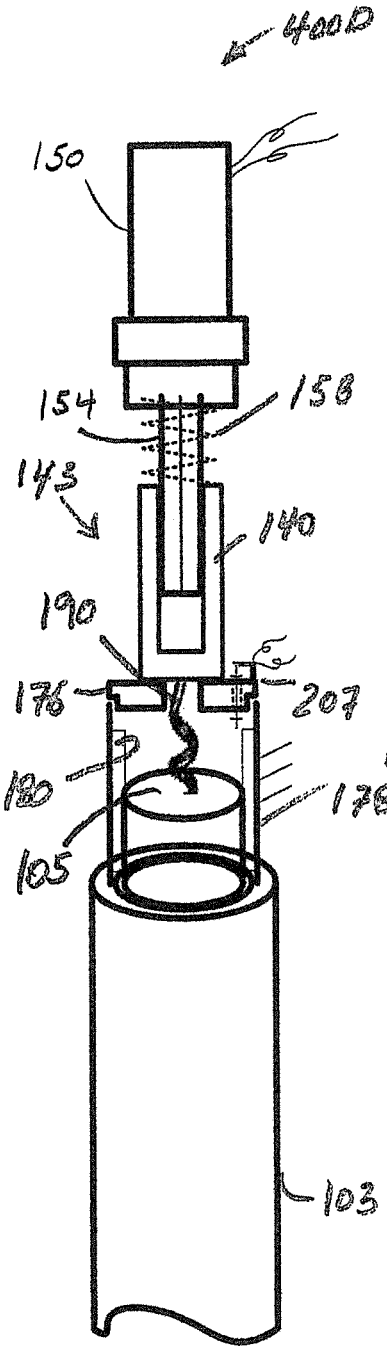

In FIG. 4D, during forward motor operation the cork 105 rises within the cork sleeve 178 as it advances along the length of the corkscrew 190. Notably, ribs 180 within the cork sleeve prevent cork rotation with respect to the cork sleeve and enable the corkscrew to advance into the cork.

Figure 4E:
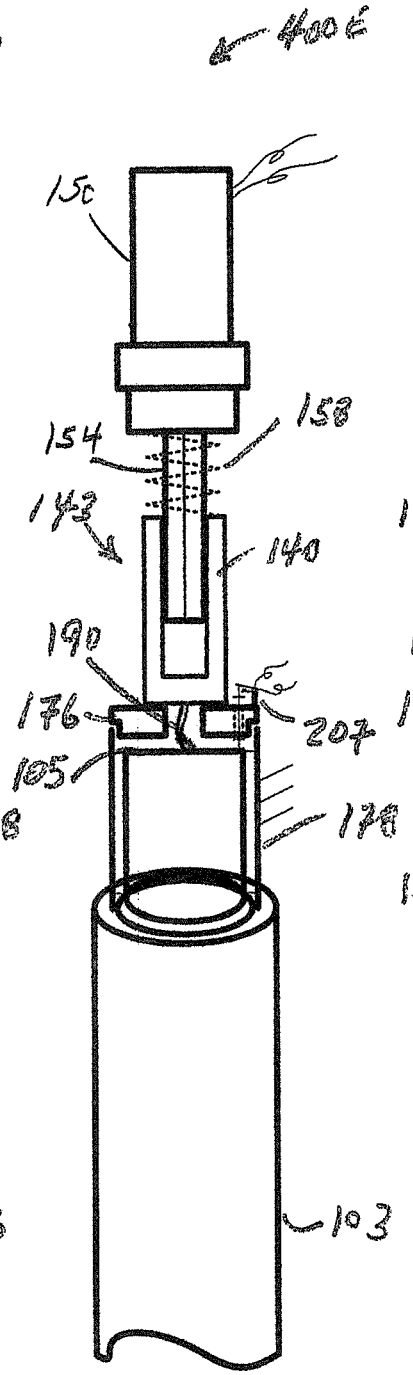

In FIG. 4E, forward motor operation ceases when the cork 105 rises within the cork sleeve 178 until it pushes the plunger 211 (see FIG. 2C) up and opens the cork sensor switch 207. At this point, the cork is extracted from the bottle or nearly so such that opening of the lever 120 enables the bottle to be withdrawn from the extractor 130 free of the cork which remains fixed to the corkscrew 190.

Figure 4F:
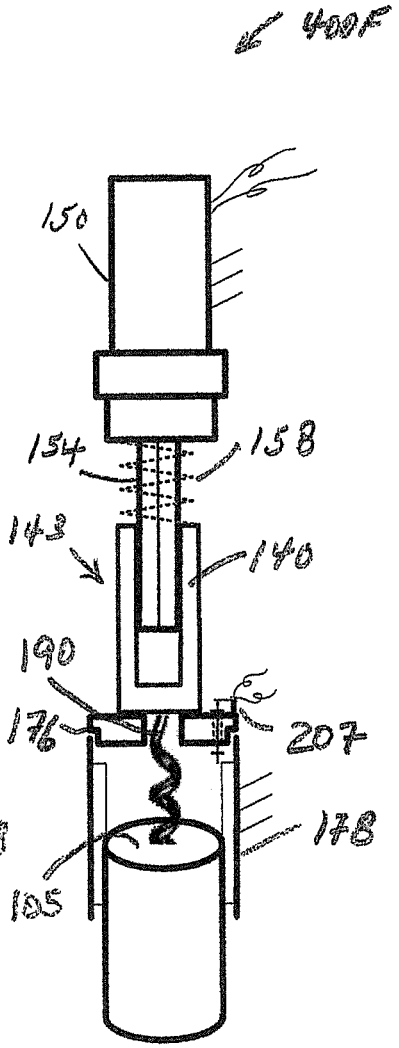

In FIG. 4F, reverse motor operation has started, for example by operating the switch on the extractor housing 205. During reverse motor operation the corkscrew 190 turns out of the cork 105 and pushes the cork out of the cork sleeve 178 as cork rotation is prevented by cork ribs 180 within the cork sleeve. This may cause the collar 140 to slide upwards resulting in compression of the spring 154. When the cork is free of the corkscrew and falls from the extractor the user releases the extractor housing switch which returns the extractor to the inoperative state of FIG. 4A.

In another embodiment, FIGS. 5A-F show details of mechanical operation 500A-F for the cork extractor mechanism 202 which includes a telescoping section 145 with a collar 156 and a pin 160 that slides within the collar. Note that the motor 150 and the cork sleeve 178 are fixed with respect to each other. For example, each of the motor and cork sleeve may be fixed to the extractor housing 131 as illustrated above.

Figure 5A:
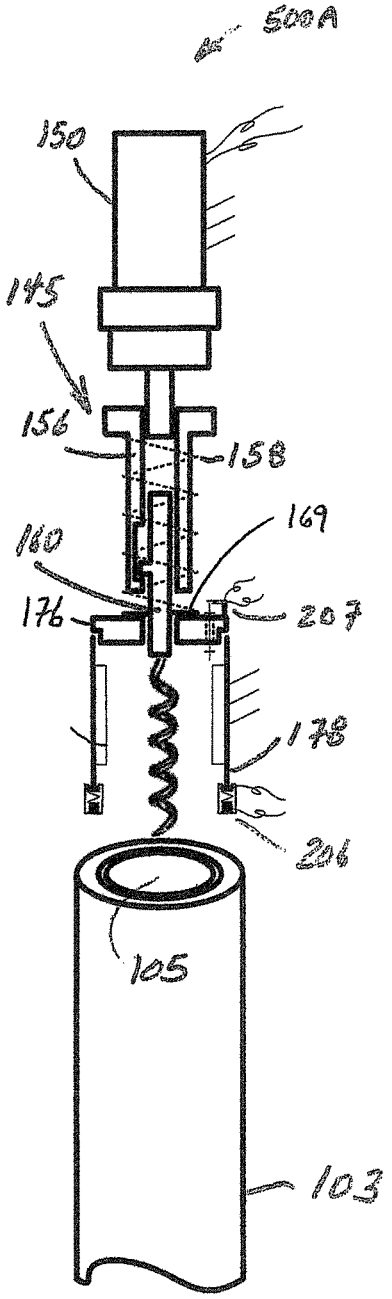
FIGS. 5A-F show use of a second cork extractor similar to the one of FIG. 1D.

In FIG. 5A the cork 105 has yet to reach and meet the corkscrew 190. Forward motor operation may be controlled by the bottle rim switch 206 or by the lever switch 203 or by both of these switches. In an embodiment, the motor is not operating at this time.

Figure 5B:
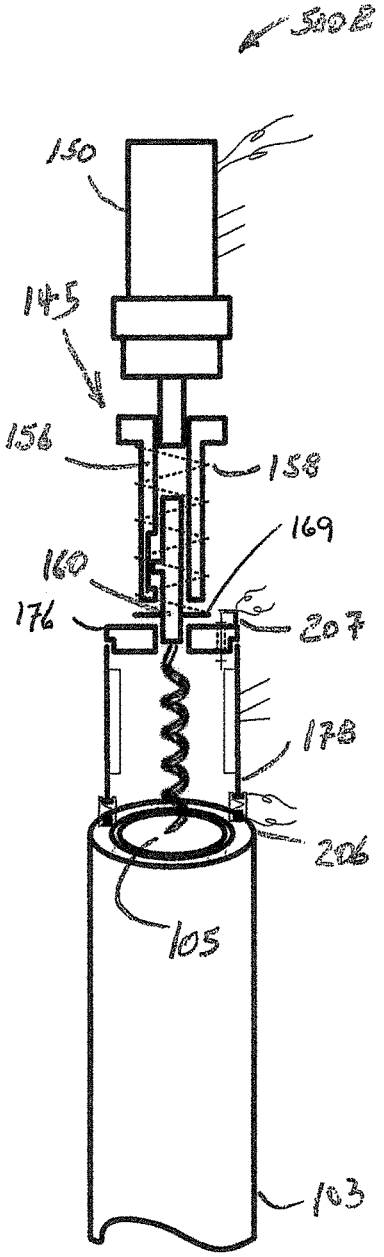

In FIG. 5B, the cork 105 has reached and meets the corkscrew 190. As seen, the spring 158 is compressed as the pin 160 rises in the collar 156 due to the cork/corkscrew contact. Note that the pin plate 169 is lifted away from the cork sleeve cap 176 during this time.

Figure 5C:
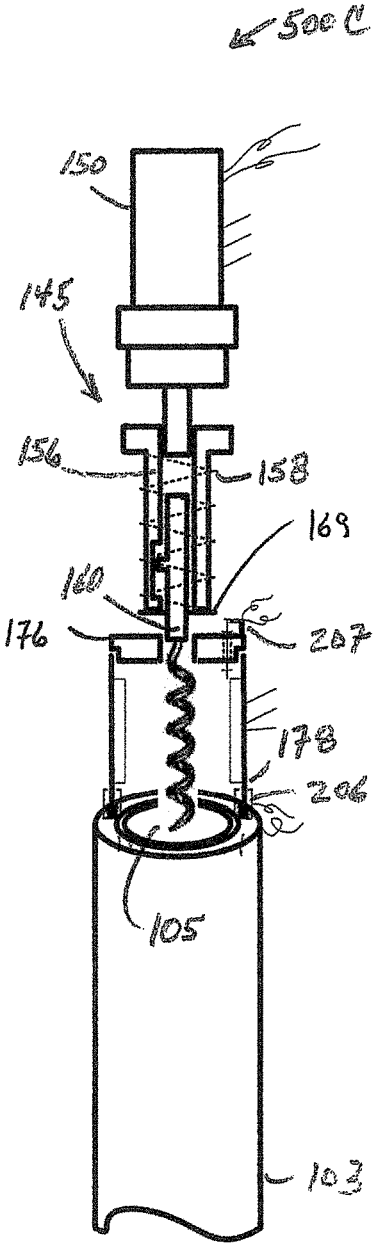

In FIG. 5C, the spring is compressed further as the pin 160 rises in the collar 156 due to the cork/corkscrew contact. Note that the pin plate 169 is now near or against the collar 156.

Figure 5D:
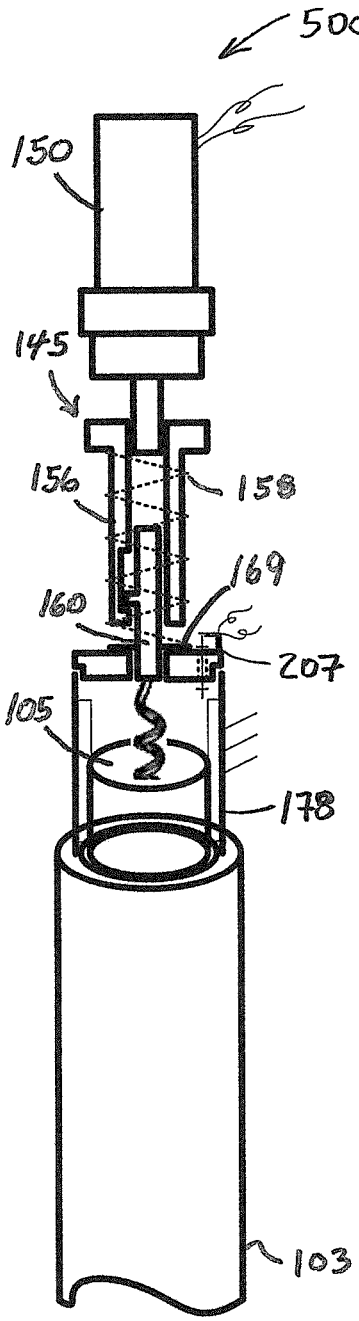

In FIG. 5D, forward motor operation begins and advances the corkscrew 190, which is biased toward the cork by the spring 158, into the cork. The corkscrew 190 turns a distance into the cork 105 as the pin 160 is lowered and the pin plate 169 comes to rest against the cork sleeve cap 176. During this operation, the cork 105 begins to be pulled from the bottle 102 as the corkscrew advances into the cork. Note that the force required to extract the cork is balanced by the force between the pin plate 169 and the cork sleeve cap 176 (see 176 on FIGS. 5A-C). As mentioned above, forward motor operation may be controlled by the bottle rim switch 206 or by the lever switch 203 or by both of these switches. In some embodiments there is an automatic device start when a user 1) pushes the extractor down on a bottle and compressing the spring and actuating switch 206 and 2) squeezes the lever actuating switch 203.

Figure 5E:
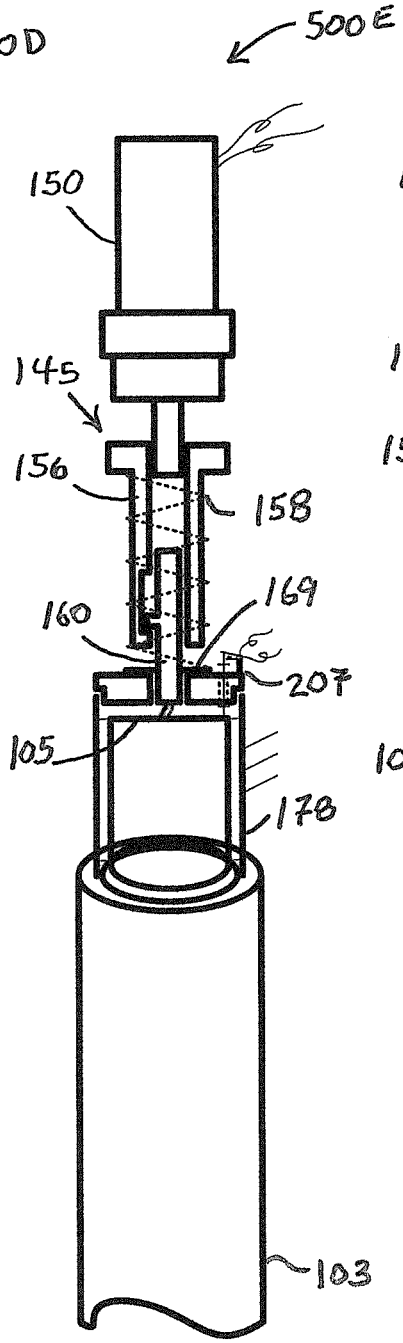

In FIG. 5E, forward motor operation ceases when the cork 105 rises within the cork sleeve 178 until it pushes the plunger 211 (see FIG. 2C) up and opens the cork sensor switch 207. At this point, the cork is extracted from the bottle or nearly so such that opening of the lever 120 enables the bottle to be withdrawn from the extractor 130 free of the cork which remains fixed to the corkscrew 190. Notably, as the cork rises in the cork sleeve ribs 180 within the cork sleeve prevent cork rotation.

Figure 5F:
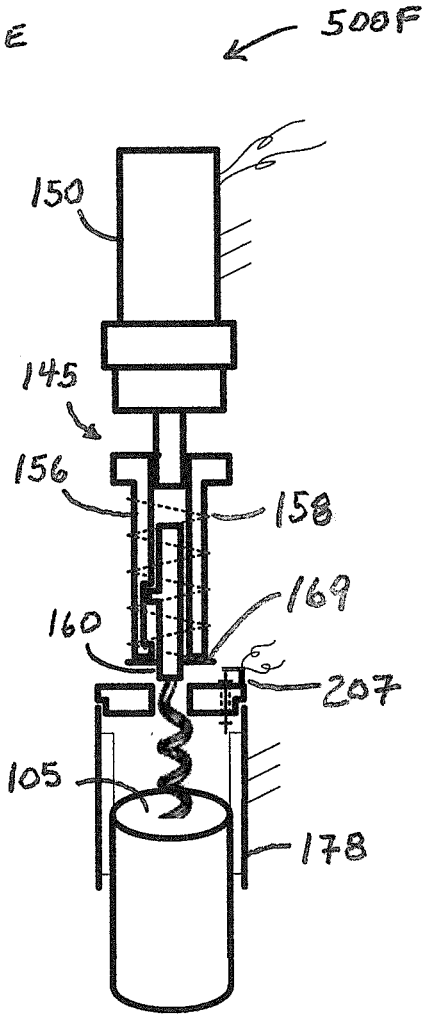

In FIG. 5F, reverse motor operation has started, for example by operating the switch on the extractor housing 205. During reverse motor operation the corkscrew 190 turns out of the cork 105 and pushes the cork out of the cork sleeve 178 as cork rotation is again prevented by cork ribs 180 within the cork sleeve. This may cause the pin 160 to slide back upward within the collar and to compress spring 158. When the cork is free of the corkscrew and falls from the extractor the user releases the extractor housing switch which returns the extractor to the inoperative state of FIG. 5A.

FIG. 6A-D show how various controls may be used to operate the extractor 600A-D. While the description which follows assumes S0-S6 operate like electrical switches, it should be noted that any of these devices or combinations of these devices may be switches, single pole single throw switches, ganged switches, electrical contact devices, electromagnetic devices, load cells, strain gauges, optical devices, and other switching/proximity devices with similar functions.

FIG. 3 shows switches including S0-S6 and arrangement of these switches with respect to the extractor 130. FIG. 6A-D show how switches including any of S0-S6 may be interconnected 600A-D. For example, FIG. 3 shows that either schematically or as actually arranged: S1 actuated by a hand operated lever 120, S2/S3/S4 positioned for actuation by the same hand, S5 actuated by a rising cork 105, and S6 actuated by contact with a bottle 102. Notably, S1 and S6 may be used separately or together. For example, S1 may cause forward operation of the motor. For example, S6 may cause forward operation of the motor. For example, both S1 and S6 may be operated to cause forward operation of the motor.

In FIG. 6A-B, forward-reverse motor operation occurs in response to actuation of independently operated switching sections G1 and G2.

Forward motor operation occurs when switching section G1 is actuated which closes switch S1 and/or S6. Here, for example, a lever switch S1 is closed, reversing switches S2/S3 are open, safety− switch S4 is closed, cork sensor switch S5 is closed, and safety+ switch S0 is closed. With these switch settings, the motor may be powered in a forward direction by virtue of a positive (+) supply interconnected with the s motor terminal.

With the above switch arrangement, the motor stops operating when the cork sensor switch S5 is opened by a cork 150 that lifts the plunger 211 in the cork sensor switch. In this state, switch settings are S0/S1/S4 closed and S2/S3/S5 open.

Reverse motor operation occurs when switching section G1 is not actuated and when switching section G2 is actuated. Here, for example, lever switch S1 is open, reversing switches S2/S3 are closed, safety− switch S4 is open, cork sensor switch S5 goes open, and safety+ switch S0 is open. With these switch settings, the motor may be powered in a reverse direction by virtue of a negative (−) supply interconnected with the s motor terminal.

When the ejector is idle or not in use, the lever 120 is assumed to be open such that switch S1 is open. The other switch positions are S0/S4/S5 closed and S1/S2/S3 open.

Figures 6C, 6D:
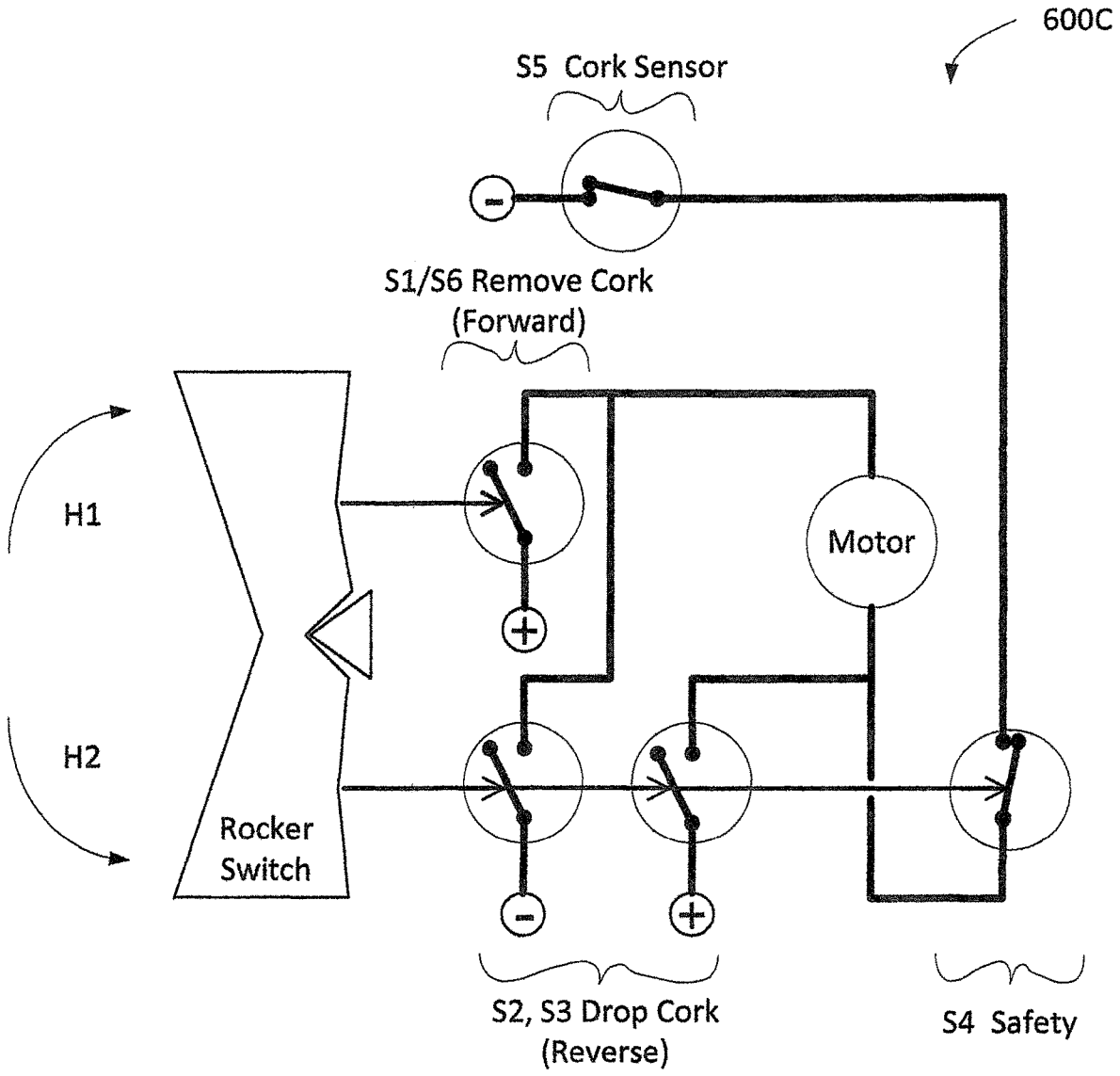

FIG. 6C-D present another embodiment. Here, forward-reverse motor operation occurs in response to actuation of switching sections H1 and H2 which are not independent. Rather, these switching sections are operated in an either/or fashion as by a rocker switch that actuates either section H1 or section 112.

As shown, operation of S1 and/or S6 causes forward operation of the motor when, for example, a lever switch S1 is closed, reversing switches S2-S3 are open, safety switch S4 is closed and cork sensor switch S5 is closed. With these switch settings, the motor may be powered in a forward direction by virtue of a positive (+) supply interconnected with the s motor terminal.

With the above switch arrangement, the motor stops operating when the cork sensor switch S5 is opened by a cork 150 that lifts the plunger 211 in the cork sensor switch.

Reverse motor operation occurs when rocker switch is moved to actuate 112 instead of H1. Here, for example, lever switch S1 is open, reversing switches S2/S3 are closed, safety− switch S4 is open, and cork sensor switch S5 goes open. With these switch settings, the motor may be powered in a reverse direction by virtue of a negative (−) supply interconnected with the s motor terminal.

Cork Extractor with Cylindrical Ramp

In yet another embodiment, a cork extractor includes a cylindrical ramp.

Figure 7A:
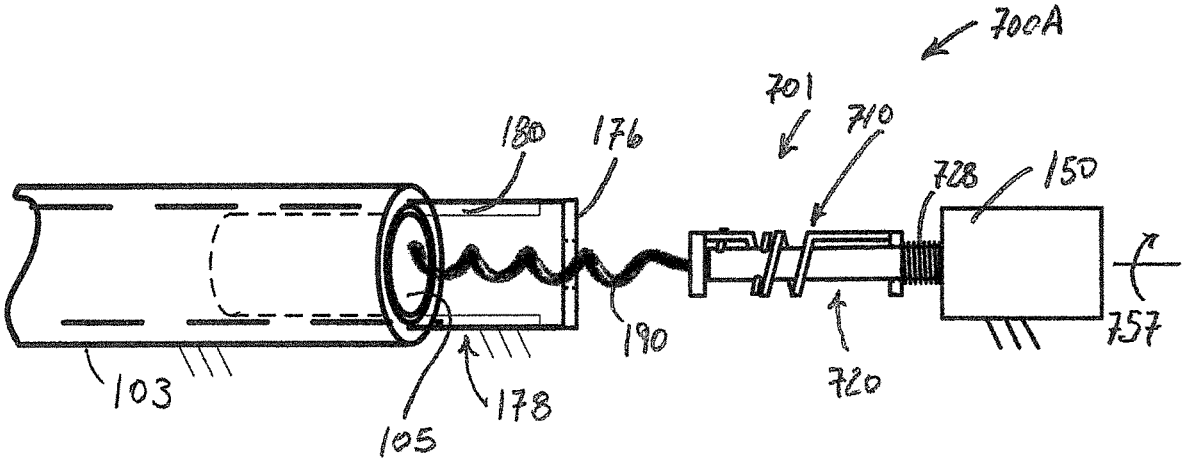
FIGS. 7A-F show an alternative cork extraction mechanism in accordance with the present invention.

FIG. 7A shows the cork extraction mechanism with the motor at rest and before cork extraction begins 700A. As seen, the bottle neck 103 is engaged by a cork extraction mechanism 701 including a corkscrew 190 attached to a cylindrical ramp 710. At a distal end of the mechanism the corkscrew passes through a cork sleeve 178 via a cork sleeve cap 176 and may be pressed against a cork 105 lodged in the bottle neck. The ramp surrounds a motor shaft 720 protruding from a motor 150 and a spring 728 around the motor shaft may bias the ramp away from the motor.

Figure 7B:
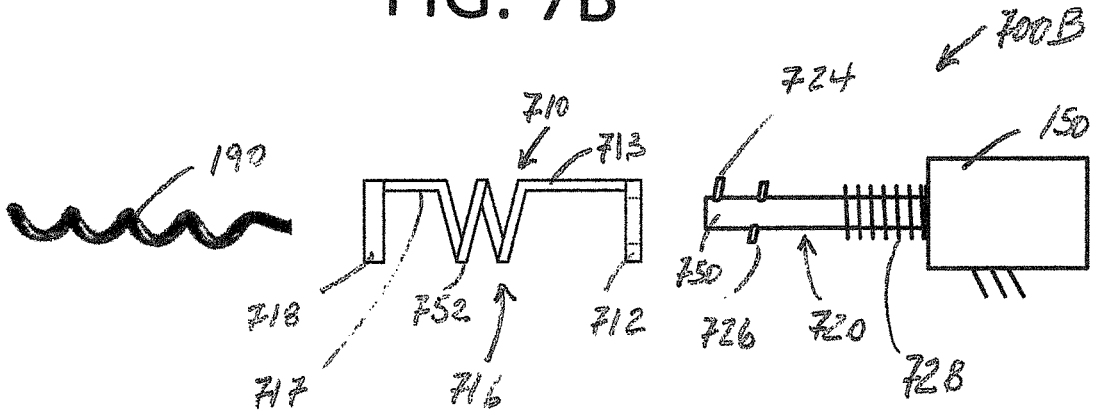

FIG. 7B shows an exploded diagram of the cork extraction mechanism 700B. The motor 150 is fixed relative to the bottle neck 103 and a shaft 720 protruding from the motor is pointed toward the corkscrew 190. The spring 728 surrounding the motor shaft is between one or more posts 724, 726 and the motor and the posts extend radially from the shaft 720 near a distal end of the shaft 750. The cylindrical ramp 710 is for attachment to the corkscrew 190 and for receiving the motor shaft 720.

In various embodiments, there is a distal post 724 and in various embodiments there is a proximal post 726. And, in various embodiments, one or more of the posts extend from the shaft in a single direction and may be termed a one-armed post. And, in various embodiments, one or more of the posts extend from the shaft is two directions and may be termed a two-armed post. As shown, the distal post 724 is a one-armed post and the proximal post 726 is a two-armed post.

The cylindrical rack 710 includes a stop at one end 718 and a guide ring 712 at an opposite end. Between the ends, the rack includes a wire or similar coil 716 that is joined at one end to the guide ring, for example by a somewhat straight section of wire 713 and joined at the other end to the stop, for example by a somewhat straight section of wire 717.

The guide ring is for surrounding the motor shaft 720 and the one or more posts 724, 726 are for engaging the coil 716. In some embodiments one or more posts may engage the coil 716 and/or one or both sections of wire 713, 717.

Motor at Rest Before Cork Extraction

Referring again to FIG. 7A, the spring 728 biases the cylindrical ramp 710 and coupled corkscrew 190 such that the corkscrew presses against the cork 105. In the view shown, note that the posts 724, 726 engage the cylindrical ramp 710. The distal post may be behind the stop wire 717 and the proximal post may be adjacent to a first coil 752 of the circular ramp.

Sinking Corkscrew into Cork

Note that motor rotation is taken from the motor end opposite the shaft such that item 757 indicates clockwise motor rotation. As such, clockwise motor rotation 757 results in rotation of the posts 724, 726 which engage the cylindrical ramp and which may tend to push the cylindrical ramp 710 away from the motor 150. Because the corkscrew 190 is coupled to the ramp, ramp advancement will result in the corkscrew being pushed into the cork 105 by the motor 150.

In a particular rotating embodiment, engagement of the cylindrical ramp 710 and post(s) 724, 726 may result in rotation of motor shaft 720 relative to the ramp. This may occur when friction such as between the post(s) and the coil 716 is low and allows slipping. This may also occur when the corkscrew 190 engages the cork 105 with a low force that permits advancement. In this case, the ramp is advanced and the corkscrew is not rotated.

And in a particular advancement embodiment, engagement of the ramp 710 and post(s) 724, 726 may result in no rotation of the motor shaft 720 relative to the ramp. This occurs when friction such as between the post(s) 724, 726 and the coil 716 is high enough to cause sticking. This may also occur when the corkscrew 190 engages the cork 105 with force sufficient to prevent advancement. In this case, the ramp is not advanced. Rather, the corkscrew is rotated.

It should be noted that the rotating and advancement embodiments can be described or described in part as surfaces alternating between sticking to each other and sliding over each other, with a corresponding change in the force of friction. Typically, the static friction coefficient (a heuristic number) between two surfaces is larger than the kinetic friction coefficient. If an applied force is large enough to overcome the static friction, then the reduction of the friction to the kinetic friction can cause a sudden jump in the velocity of the movement.

Figure 7C:
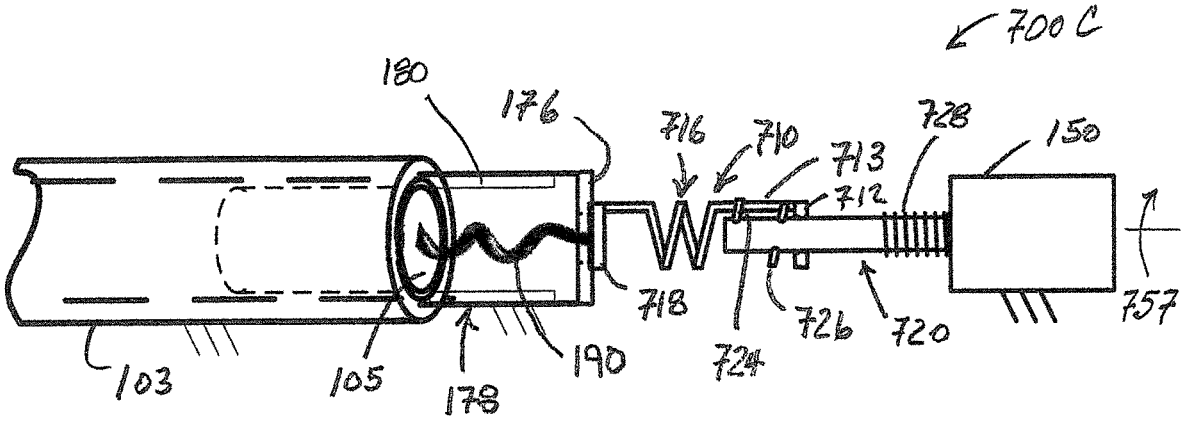

FIG. 7C shows the corkscrew advanced into the cork 700C. This advancement may occur when the motor shaft 720 rotates clockwise and alternately advances and rotates the corkscrew 190. As described above, corkscrew advancement may occur during post 724, 726 and coil 716 slipping while corkscrew rotation occurs during post and coil sticking.

After the corkscrew 190 penetrates the cork 105, the ramp stop 718 may abut the sleeve cap 176 and/or the proximal post 726 may abut the guide ring 712. This stops advancement of the ramp 710.

Extracting the Cork from the Bottleneck

Figure 7D:
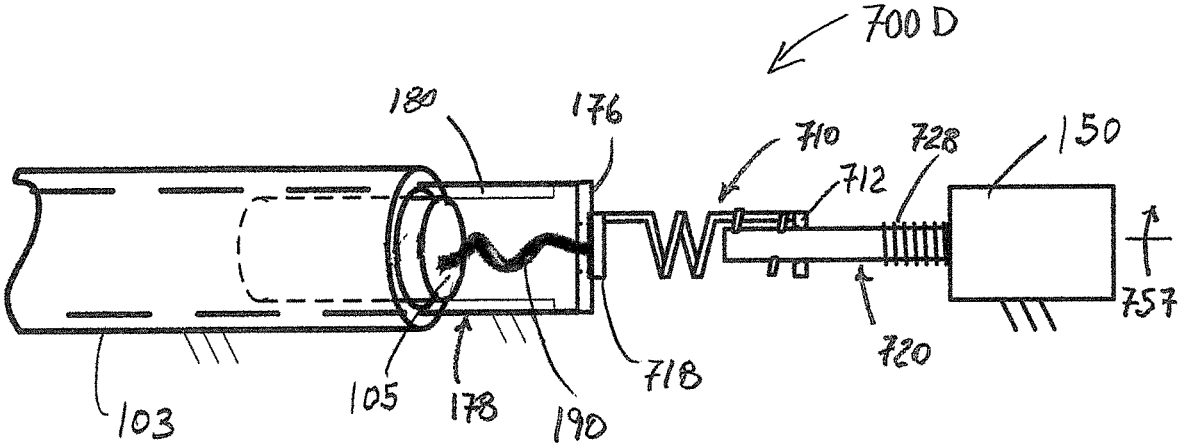

FIG. 7D shows continued clockwise rotation of the motor 700D. Because advancement of the ramp 710 is stopped, clockwise rotation of the corkscrew 190 causes the cork 105 to begin leaving the bottle 103 and to begin entry into the cork sleeve 178. Notably, the cork sleeve ribs 180 prevent rotation of the cork relative to the cork sleeve 178.

Figure 7E:
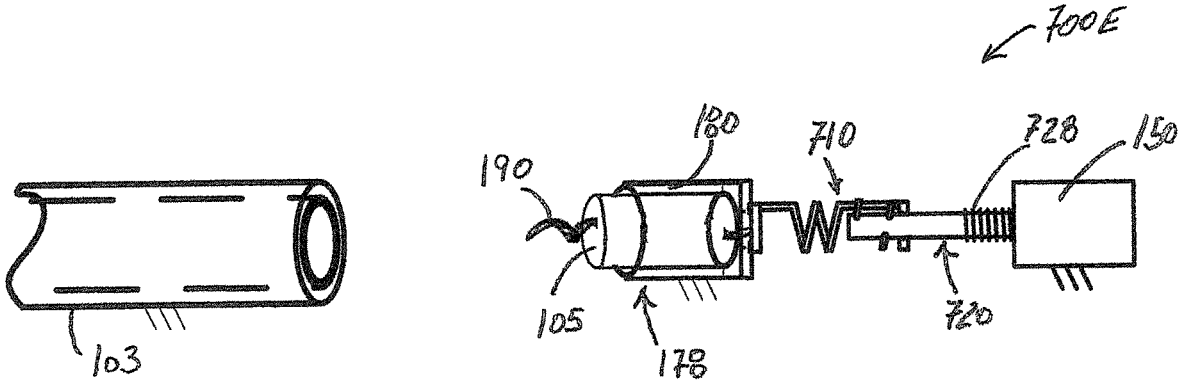

FIG. 7E shows clockwise rotation ended and the motor stopped 700E. As seen, the cork 105 is drawn deep into the cork sleeve 178. In various embodiments, a switch may stop motor clockwise rotation.

Ejecting the Cork from the Cork Sleeve

Figure 7F:
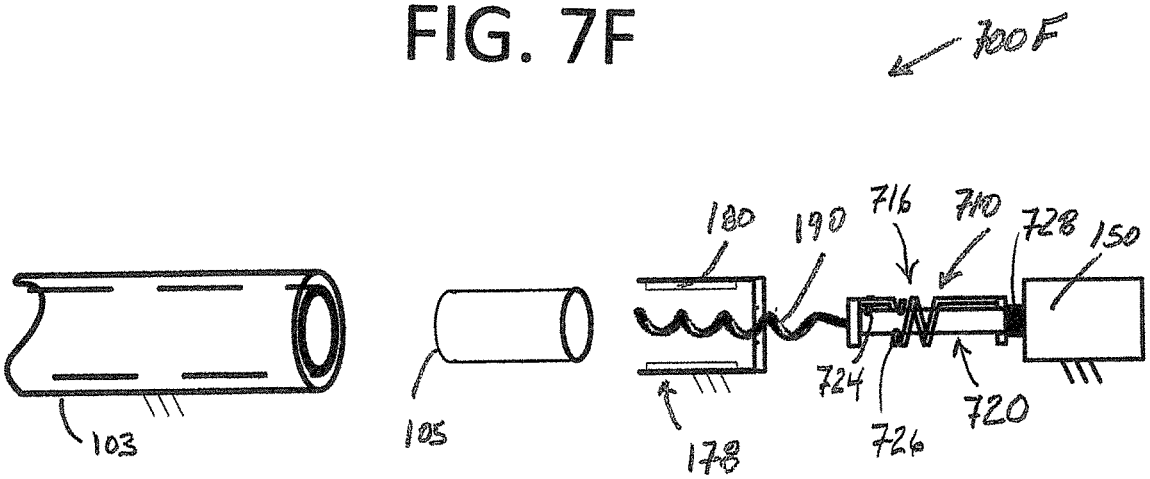

FIG. 7F shows counterclockwise rotation of the motor 700F. During counterclockwise rotation of the motor 150, the ramp 710 is drawn back onto the shaft 720 as the post(s) 724, 726 engage the coil 716 and move it toward the motor such that the spring 728 is compressed between guide ring 712 and the motor 150. And, during counterclockwise rotation of the motor, the corkscrew 190 rotates relative to the cork 105 such that the cork is ejected from the cork sleeve 178; this may occur when the ramp and spring are sticking. In various embodiments, a switch may stop motor counterclockwise rotation.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments but should be defined only in accordance with the following claims and equivalents thereof.

What is claimed is:

1. A cork extractor comprising: a shaft interconnecting a corkscrew and a motor by a cylindrical ramp;

the corkscrew connected to a distal end of said cylindrical ramp;

the cylindrical ramp encircling the shaft;

said cylindrical ramp comprising a wire body slideable about the shaft, a post extending radially from the shaft, the post for engaging a cylindrical ramp coil;

the corkscrew for entering a cork lodged in a bottle when the cylindrical ramp translates away from the motor; and, the cork removed from the bottle when the corkscrew rotates but does not translate with respect to the cork.

2. The cork extractor of claim 1 further comprising:

an internally ribbed cork sleeve fixed with respect to the motor;

the cork sleeve for abutting a bottle mouth, the corkscrew passing through the cork sleeve;

the cork drawn into the cork sleeve when the cork is removed from the bottle; and, the cork ejected from the cork sleeve when the motor reverses its direction of rotation, the cylindrical ramp translates toward the motor, and the corkscrew exits the cork.

3. The cork extractor of claim 2 further including a spring between the motor and the cylindrical ramp.

4. The cork extractor of claim 3 wherein the spring is for urging the corkscrew to press against the cork before the corkscrew enters the cork.

5. The cork extractor of claim 4 wherein the post is located at a distal end of the shaft.

* * * * *